US008517557B2

(12) United States Patent
Albaladejo Jimenez

(10) Patent No.: US 8,517,557 B2
(45) Date of Patent: Aug. 27, 2013

(54) BLACK LIGHT LICE COMB

(75) Inventor: Carlos Jose Albaladejo Jimenez, Madrid (ES)

(73) Assignee: Laboratorios Farmaceuticos Rovi, S.A. (ES)

( * ) Notice: Subject to any disclaimer, the term of this patent is extended or adjusted under 35 U.S.C. 154(b) by 0 days.

(21) Appl. No.: 13/147,756

(22) PCT Filed: Feb. 8, 2010

(86) PCT No.: PCT/ES2010/000051

§ 371 (c)(1),
(2), (4) Date: Sep. 15, 2011

(87) PCT Pub. No.: WO2010/089433

PCT Pub. Date: Aug. 12, 2010

(65) Prior Publication Data

US 2012/0051085 A1 Mar. 1, 2012

(30) Foreign Application Priority Data

Feb. 9, 2009 (ES) ..... 200900213 U

(51) Int. Cl.
*F21V 33/00* (2006.01)

(52) U.S. Cl.
USPC ..... 362/109; 362/234; 362/554

(58) Field of Classification Search
USPC ..... 362/109, 234, 267, 554; 132/120, 132/121, 213.1, 219
See application file for complete search history.

(56) References Cited

U.S. PATENT DOCUMENTS

| | | | | |
|---|---|---|---|---|
| 1,669,100 | A * | 5/1928 | Overholt | 132/121 |
| 4,380,790 | A | 4/1983 | Saferstein | |
| 5,261,427 | A | 11/1993 | Dolev | |
| 5,618,289 | A | 4/1997 | Aragona | |
| 5,972,987 | A | 10/1999 | Reid | |
| 6,053,180 | A | 4/2000 | Kwan | |
| 2008/0177255 | A1 * | 7/2008 | Bernardini | 132/219 |
| 2008/0212312 | A1 * | 9/2008 | Kaufinann et al. | 362/109 |

FOREIGN PATENT DOCUMENTS

| | | |
|---|---|---|
| EP | 0693262 | 1/1996 |
| WO | 9115134 | 10/1991 |
| WO | 9935498 | 7/1999 |
| WO | 9952410 | 10/1999 |
| WO | 2008088792 | 7/2008 |
| WO | 2008088795 | 7/2008 |
| WO | 2008099408 | 8/2008 |

* cited by examiner

*Primary Examiner* — Y My Quach Lee
(74) *Attorney, Agent, or Firm* — Cantor Colburn LLP

(57) ABSTRACT

A black light lice comb which can be easily held as it is being used to examine, clean and remove and/or eliminate nits, lice, eggs or nymphs on the scalp or from environments in which remains my be found wherein the comb is structured around a body including a battery compartment which is accessed at one end of the body and which is provided with a lamp device that contains diodes that emit black light and which is enclosed by means of a lens through which the light emitted by said diodes is projected, while one line or edge of the body contains a row of LEDs emitting black light corresponding to a guide from which a lice comb means is projected, formed by a plurality of teeth made from a material that conducts the black light emitted by the row of LEDs.

6 Claims, 5 Drawing Sheets

BLACK LIGHT LICE COMB

OBJECT OF THE INVENTION

Given the large problem in society with outbreaks of lice, which, year after year, infect in particular the child population in schools, nurseries, parks, sports centres, places of study and leisure, in general, I have found that no pharmaceutical or chemical product is one hundred per cent effective in eradicating said outbreaks completely. Traditional pediculicides are permethrin, malathion and phenothrin based products and the most current, a dimethicone-based product. Several of these products are highly toxic and, as such, are not recommended, above all, for use on infants and very young children, who also experience this problem. In addition, given the emergence of pockets of resistance and that the lice are becoming more resistant, these chemical insecticides are becoming less and less effective.

Therefore, I believe the only really effective solution to clean the entire head of hair is full and precise removal of all lice and each one of the lice and nits present on the infected person's head, for which visual location of any insect or nit that confirms that the hair is clean is absolutely essential. To do this, very good eyesight and many hours inspecting the child's head would be required.

Pediculicides are often accompanied by combs or lice combs that remove nits and lice, after treatment. Nonetheless, as there is no reliable way of checking removal of the insects and subsequent cleaning, it is quite possible that complete removal and disinfection has not been carried out, so that the infestation occurs over and over again, with the ensuing inconvenience in the individual's life.

The invention herein, as expressed in the title of this descriptive memory relates to a device that detects the smallest louse or nit attached to the human hair on the entire scalp, by means of vision contrasted via black light, which has been designed and made in order to obtain many, notable changes and advantages in relation to other existing lice combs that, as do not have a light, are much less effective.

BACKGROUND OF THE INVENTION

There are numerous devices and means for removal of lice and nits from human hair.

In this regard, plastic and metal devices, micro-channelled or not, may be cited, and even removable dual-tooth and electric-sound lice combs which, without light, emit a constant beep that cuts out on closing the circuit on locating a louse, but it proves really inefficient with nits.

These systems have the disadvantage of not being backlit by the said black light, so it is impossible for the user to determine whether or not the lice comb contains infection in the form of eggs, which often cause them to be returned to the human hair or, worse still, that they are the cause of new infections or the spreading of these infections in the individual or in other individuals in the environment where treatment is carried out using the same comb.

Currently, there is no known lice comb of the type proposed, with black light and which I have tested that is hugely effective, for the following reasons:

1.—One hundred per cent efficiency guaranteed to locate any louse or nit however small it may be.

2.—Can be used at any age, without risk or exposure to chemical products or agents.

3.—Ease of use of the device while the infected person, usually young children, are sleeping, as the lights must be off.

4.—I propose a treatment that is so thorough and without any risk to health, that it leaves no margin for error and completely resolves the infection in the individual.

DESCRIPTION OF THE INVENTION

This is a device consisting of a handle that contains batteries and at whose end there is a black light lens, by way of a lamp. This lamp is used to carry out a first examination of the scalp or environments where the infested head may have left traces of infection, such as pillows, chairs, sofas, towels, hats, etc.

On the lower part of the handle there is a guide of light-emitting diodes or LEDs emitting black light, to which the comb or lice comb that is composed of teeth or teeth embedded in the LEDs is coupled, absorbing the black light and being fully illuminated on turning on the lice comb light, when the room light is turned off locating in this way every single insect or egg on the patient's head.

Lice comb teeth are made of plastic or optical fibre or silica material or any other material particularly sensitive to the transmission of light, such as some form of polyethylene. In this way, they will be fully lit up as if it were a fluorescent black light, which helps to perfectly see the nits which are white coloured eggs, as well as the young lice or nymphs, which are very difficult to see as they are transparent, by facilitating their location and removal.

Also, there is a small opening or recess on the handle in which there is a brush with curved, firm bristles built in, which allows for effectively brushing off the nits removed in each stroke. This cleaning brush is removable.

The lice comb can be rinsed with water or some disinfectant for its easy cleaning.

To complete the description and in order to help to better understand the characteristics of the invention, accompanying the descriptive memory herein are a set of drawings in whose figures the innovations and advantages of the black light lice comb, object of the invention, will be more easily understood.

Front elevation view of the lamp, in which the black light LEDs incorporated therein can be seen.

Figure 1:
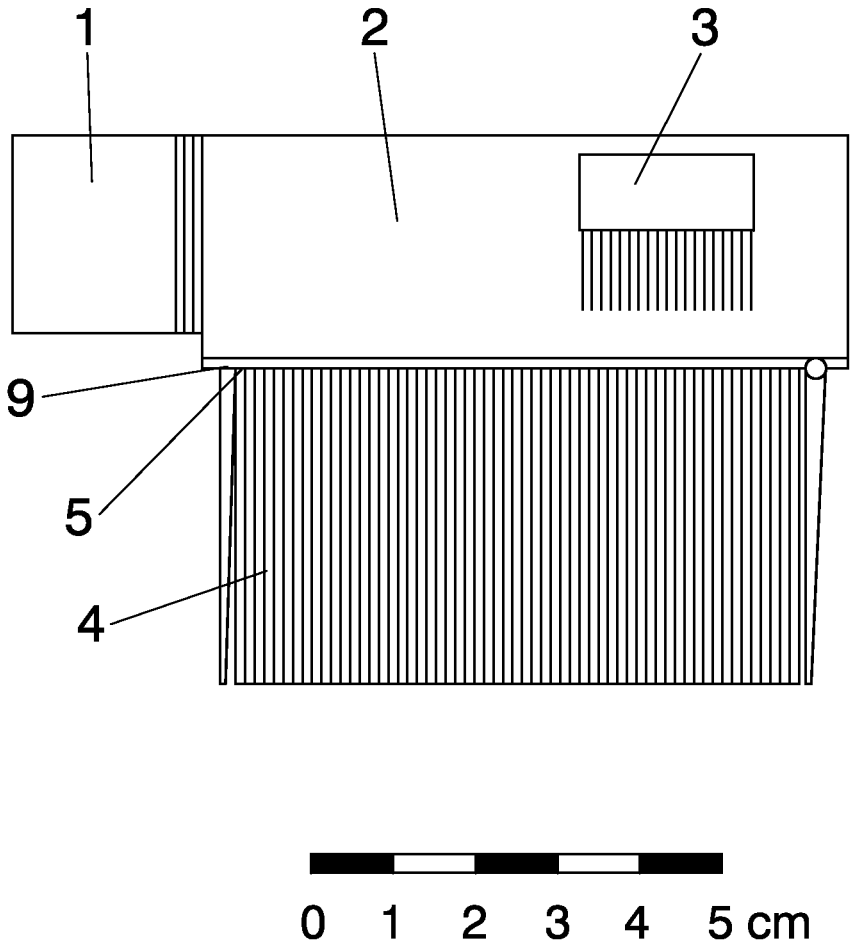
FIG. 1 shows a side elevation of the lice comb with built-in bristle brush.
Figure 2:
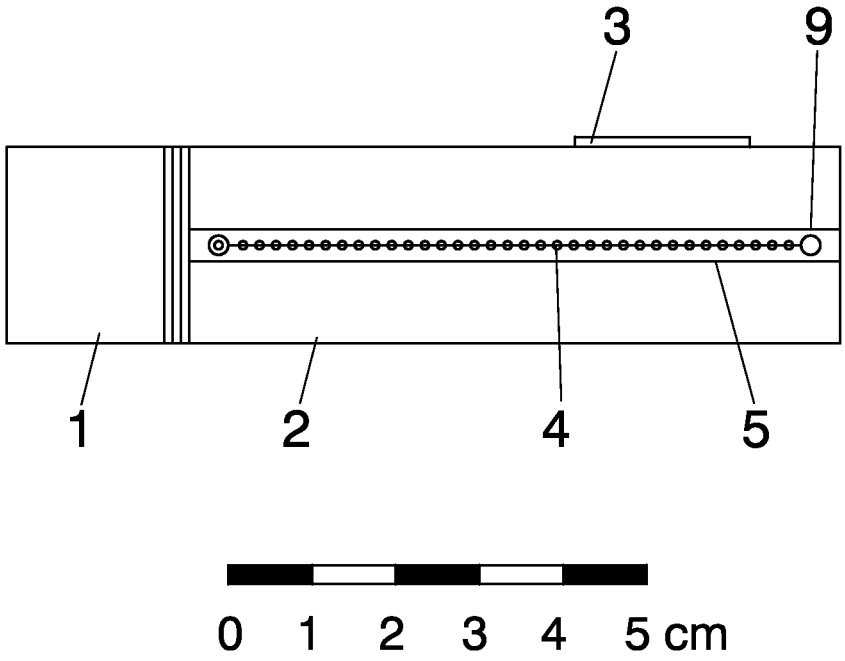

FIG. 2 shows a plan view of the underside of the piece, in which the guide where the teeth are inserted is shown.

Figure 3:
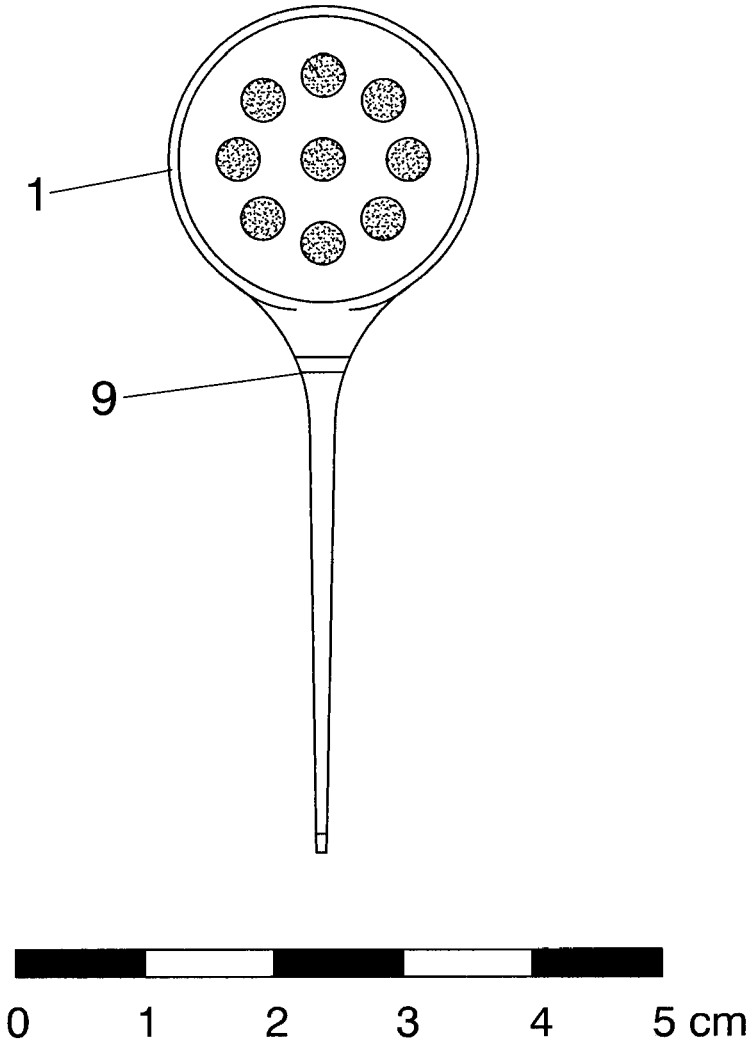

FIG. 3 shows a front elevation of the lamp, in which the black light LEDs incorporated therein can be seen.

Figure 4:
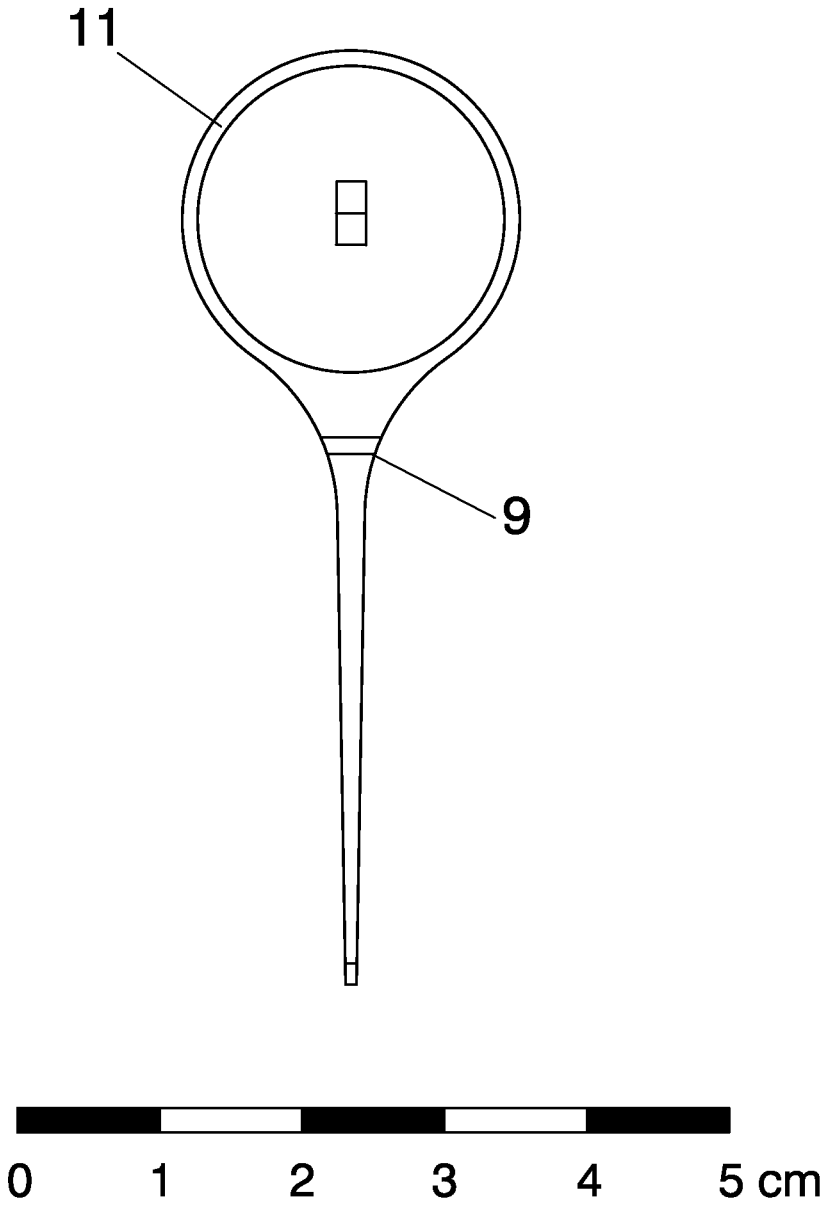

FIG. 4 shows a rear elevation of the lice comb where the cavity for the battery device is located.

Figure 5:
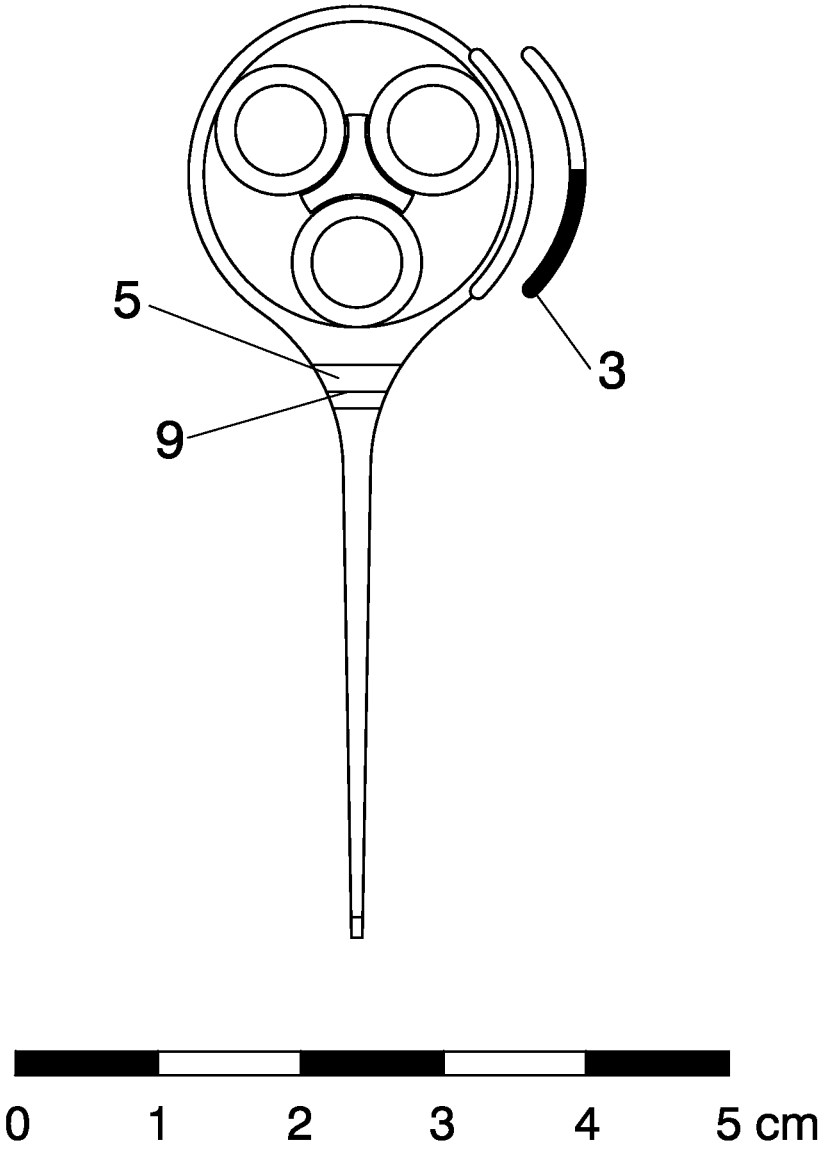

FIG. 5 shows a section of the handle through the cavity where the batteries, LEDs and teeth are inserted.

DESCRIPTION OF A PREFERRED EMBODIMENT

In view of the figures discussed, I firmly believe that the basis of the success of the black light lice comb is the superconductivity of the black light through the teeth of the lice comb (4). I therefore propose that the final material that is chosen is a material having said superconducting properties of the black light, such as for example, fibre optics or some type of polyethylene superconductor of light.

The handle (2), without doubt, should be circular in shape, such that it sits well in the hand of the individual using it and allowing it to be used from all angles on the head of the infested individual.

In the same way, the trace lamp (1) should be located at one end of the handle as a whole, to allow its use without modifying the grip of the lice comb, which facilitates handling and thereby the cleaning of the individual. This lamp (1) is located at the opposite end to where the batteries are located (11). Embedded in a side of the handle (2) there is a curved bristle brush (3) to facilitate cleaning the teeth of the lice comb (4).

The teeth (4) should be embedded under the row of black light LEDs (5) of the handle on a plastic surface (9) located below the LEDs. These teeth (4) should be fine and close together to carry out the lice and nit dragging function. They are made in the same material as the rest of the lice comb, i.e., a material having the superconducting properties of the black light, such as fibre optics or some type of polyethylene superconducting light.

The invention claimed is:

1. A black light lice comb designed so that it can be easily held when used to examine, clean, and remove and/or eliminate nits, lice, eggs or nymphs on the scalp of an affected person or from environments in which remains may be found from having been in contact with the affected person, the black light comb comprising:

a body;

a watertight compartment to contain electric batteries at a first end of the body;

a lamp device at a second end of the body, which lamp device comprises a first group of diodes that emit black light, and which lamp device is closed by a lens through which the light emitted by said first group of diodes is projectable during the examination of the patient's scalp or the infected environment;

the body further comprising a guide from which a lice comb structure is projected, formed by a plurality of teeth made with a material that conducts black light;

the black light comb further comprising a second group of diodes emitting black light separate from the first group and arranged in a row essentially corresponding to the guide, such that the plurality of teeth can be lit up by this second group of diodes.

2. Black light lice comb according to claim 1, wherein the material of the teeth of the lice comb structure is chosen from between fibre optics or some type of polyethylene material having good light conductivity.

3. Black light lice comb according to claim 1, wherein it further comprises a curved bristle brush embedded in a position on a side surface of the body, suitable for cleaning the teeth of the lice comb structure.

4. Black light lice comb according to claim 1, wherein it further comprises a switch included on a closing lid of the compartment, by means of which the black light mode is operable in different modes.

5. Black light lice comb according to claim 4, which modes can be selected among the first group of diodes being turned on, the second group of LEDs being turned on and an off position.

6. A black light lice comb designed so that it can be easily held when used to examine, clean, and remove and/or eliminate nits, lice, eggs or nymphs on the scalp of an affected person or from environments in which remains may be found from having been in contact with the affected person, the black light comb comprising:

a body;

a watertight compartment to contain electric batteries at a first end of the body;

a lamp device at a second end of the body, which lamp device comprises a first group of diodes that emit black light, and which lamp device is closed by a lens through which the light emitted by said first group of diodes is projectable during the examination of the patient's scalp or the infected environment;

the body further comprising a guide from which a lice comb structure is projected, formed by a plurality of teeth made with a material that conducts black light;

the black light comb further comprising a second group of diodes emitting black light separate from the first group and arranged in a row essentially corresponding to the guide, such that the plurality of teeth can be lit up by this second group of diodes, wherein the material of the teeth of the lice comb structure is chosen from between fibre optics or some type of polyethylene material having good light conductivity, and wherein it further comprises a curved bristle brush embedded in a position on a side surface of the body, suitable for cleaning the teeth of the lice comb structure.

* * * * *